United States Patent [19]

Kiger et al.

[11] Patent Number: 4,676,723

[45] Date of Patent: Jun. 30, 1987

[54] LOCKING SYSTEM FOR A TURBINE SIDE ENTRY BLADE

[75] Inventors: William E. Kiger, Germanton, N.C.; Jurek Ferleger, Longwood, Fla.

[73] Assignee: Westinghouse Electric Corp., Pittsburgh, Pa.

[21] Appl. No.: 844,496

[22] Filed: Mar. 26, 1986

[51] Int. Cl.[4] ..... F01D 5/32

[52] U.S. Cl. ..... 416/221; 416/193 A

[58] Field of Search ..... 416/193 A, 221, 220 R

[56] References Cited

U.S. PATENT DOCUMENTS

| | | | |
|---|---|---|---|
| 2,843,356 | 7/1958 | Hull | 416/220 X |
| 2,867,408 | 1/1959 | Kolb et al. | 416/220 R |
| 2,942,842 | 6/1960 | Hayes | 416/221 |
| 2,949,278 | 8/1960 | McCormick | 416/220 R |
| 2,963,271 | 12/1960 | McCormick | 416/221 |
| 3,039,740 | 6/1962 | Hockert | 416/221 |
| 3,157,385 | 11/1964 | Jenson | 416/221 |
| 3,198,485 | 8/1965 | Melenchuk | 416/220 R |
| 3,202,398 | 8/1965 | Webb | 416/221 X |
| 3,904,317 | 9/1975 | Cardin | 416/220 R |

FOREIGN PATENT DOCUMENTS

| | | | |
|---|---|---|---|
| 130710 | 10/1979 | Japan | 416/220 R |
| 313027 | 4/1956 | Switzerland | 416/193 A |
| 317345 | 12/1956 | Switzerland | 416/220 R |
| 671960 | 5/1952 | United Kingdom | 416/220 |
| 924808 | 5/1963 | United Kingdom | 416/221 |
| 1399485 | 12/1973 | United Kingdom | 416/193 A |

*Primary Examiner*—Everette A. Powell, Jr.

*Attorney, Agent, or Firm*—F. J. Baehr, Jr.

[57] ABSTRACT

A locking system for attaching a circular array of side entry steam turbine blades to a rotor disc utilizing a circumferential groove in the outer periphery of the disc and a notch in one side of a blade platform to form an opening for receiving a pin which prevents the blade from sliding in the side entry slots in the disc and the next blade installed on the rotor captures a pin in the preceding blade except the last blade assembled in the array or closing blade has a kerf in the platform which registers with the circumferential groove in the disc and a locking key fitting into the kerf and groove to hold the last blade in place and the locking key being captured in the kerf and groove by a strip of metal passing through a slit in the locking key and an opening formed in the platforms.

5 Claims, 3 Drawing Figures

LOCKING SYSTEM FOR A TURBINE SIDE ENTRY BLADE

BACKGROUND OF THE INVENTION

This invention relates to steam turbines and more particularly to the closing blade locking system for a circular array of side entry rotating blades. Side entry rotating blades as shown in U.S. Pat. No. 4,533,298 are installed on a rotor disc one at a time and have a pin which is inserted after the blade is installed in a slot in the disc. The next blade to be installed captures the pin to prevent it from coming free. However the last blade to be installed cannot receive the locking pin and some other arrangement must be utilized to lock the last blade or closing blade in the circular array.

SUMMARY OF THE INVENTION

In general, a locking system for a closing blade in a circular array of side entry blades disposed in a rotor disc, when made in accordance with this invention,-comprises a disc having a centrally disposed circumferential groove for receiving locking pins and a plurality of generally axially oriented slots adapted to slidably receive the blades in such a manner as to only allow generally axial movement of the blades in the slots. The blades having a root portion which is slidably received by the slots, and a platform portion disposed radially outwardly of the root portion. The platform portion has generally parallel side margins which abut the side margins of adjacent blades. An airfoil-shaped portion extends radially outwardly from the platform portions. All blades other than the closing blade have a notch in the platform portion which registers with the circular groove. The notch cooperates with the groove to receive a locking pin which, when in place in the notch and groove, prevents the blade from moving generally axially. The abutting side margin of the adjacent blade capturing the locking pin in the notch and groove. The closing blade has a kerf in the side margin in place of the notch. A locking key fits into the kerf and the groove in the disc to prevent the closing blade from moving axially in the slot in the rotor. A step is disposed in the radially inner portion of the margin of the platform having the kerf. A slit is disposed in the locking key, which registers with the steps in the margins of the blades to form an opening and a strip fits into this opening created by the steps and the slit to lock the locking key in the kerf and groove. The ends of the strip are bent to extend radially to prevent the strip from coming out of the opening, whereby all of the blades in the circular array of side entry blades can be locked in the receiving slots in the disc.

DESCRIPTION OF THE PREFERRED EMBODIMENTS

Figure 1:
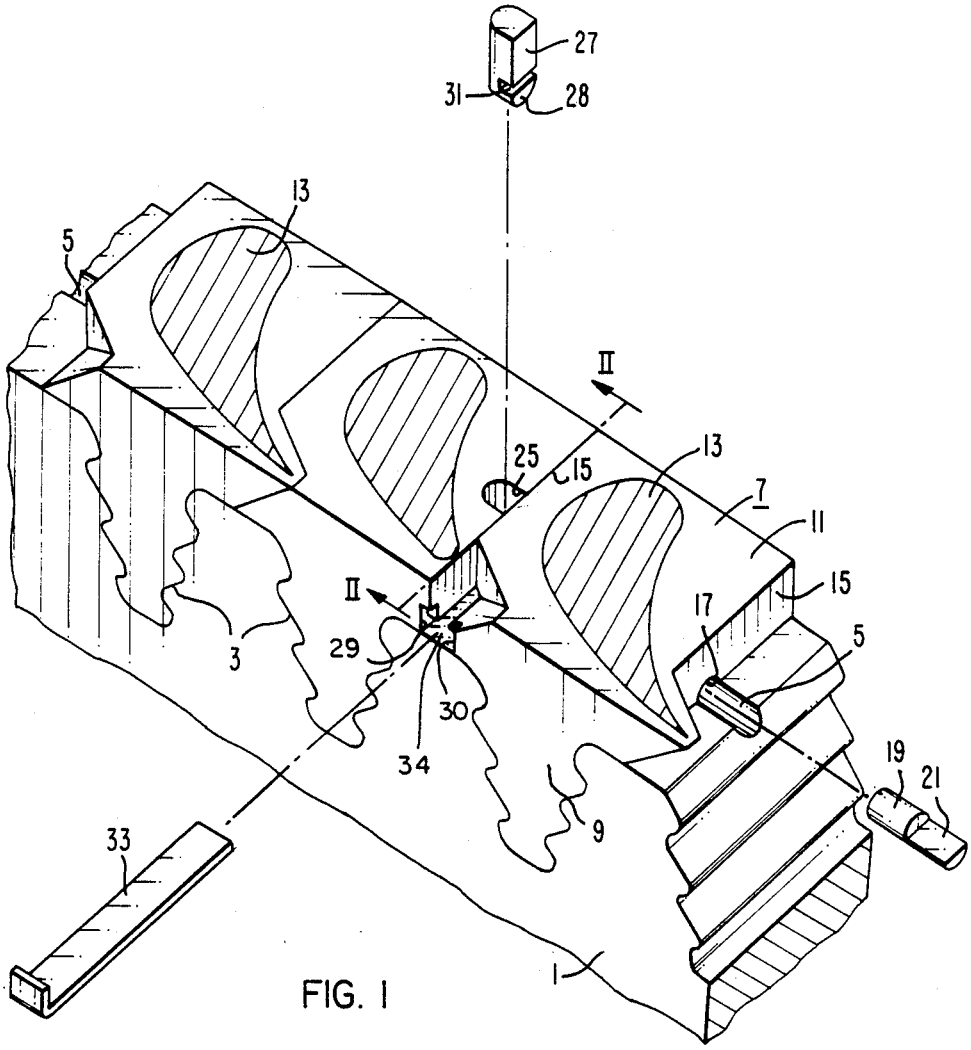
FIG. 1 is a pictorial view of a closing blade pinning arrangement for a circular array of side entry blades for a steam turbine made in accordance with this invention.
Figure 2:
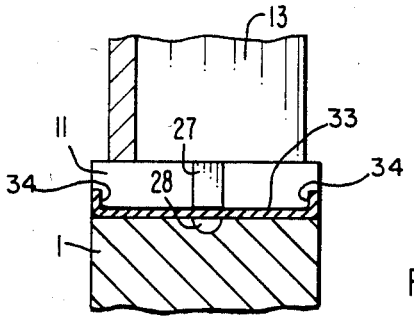
FIG. 2 is a sectional view taken on line II—II of FIG. 1.

Referring now to the drawings in detail there is shown a portion of a rotor disc 1 for a steam turbine. The disc 1 has a circular array of generally axially oriented Christmas tree shaped slots 3 which are disposed transverse, but not necessarily perpendicular to the disc 1, and a circumferentially disposed semicircular grooves centrally disposed in the outer periphery of the disc 1.

A plurality of turbine blades 7 each having a Christmas tree shaped root portion 9, a platform portion 11 disposed radially outwardly from the root portion 9 and an airfoil-shaped portion 13 extending out radially from the platform portion 9 are disposed in a circular array with the root portion 9 of the blade being slidably received in the slots 3. The platform portions 11 have generally parallel side margins 15 which abut the side margins 15 of the adjacent blades.

All blades other than the closing blade or last blade to be installed in the circular array have a notch 17 in the platform portion which registers with the circumferential groove 5. The notch 17 and groove 5 cooperate to form an opening for receiving a locking pin 19 which when in place in the opening is received by the groove 5 and notch 17 to prevent the blade from moving axially in the slot. The abutting side margin of the adjacent blade, the next blade to be installed in the disc, captures he locking pin 19 in the opening. The locking pin 19 may have a step 21 which fits in the groove 5 in such a manner that the platform 11 of the adjacent blade slides over the step 21. This prevents the locking pin 19 from sliding or rotating in the groove 5 and notch 17.

The platform 11 of the closing blade or blast blade placed in the array has a kerf 25, which registers with the groove 5 in place of the notch 17. A locking key 27 having a semicircular end 28 fits into the kerf 25 and groove 5 to prevent the closing blade from sliding axially in the slot 3.

A step 29 is disposed in the side margins 15 of the platform 11 adjacent the rotor and extends through the platform 11 of the closing blade on the margin with the kerf 25 and a step 30 is also disposed in the platform 11 adjacent the rotor in the blade abutting the closing blade. A slit 31 is disposed in the locking key 27 so as to register with an opening formed by the steps 29 and 30 and the outer periphery of the rotor. A holding strip 33 is inserted into the opening formed by the steps 29 and 30, the rotor and the slit 31 capturing the locking kerf 27 in the kerf 25 and groove 5. The ends of the strip 33 are bent radially outwardly to prevent the strip 33 from coming out of the opening. Preferably, notches 34 are provided for receiving the bent ends of the strip 33.

Figure 3:
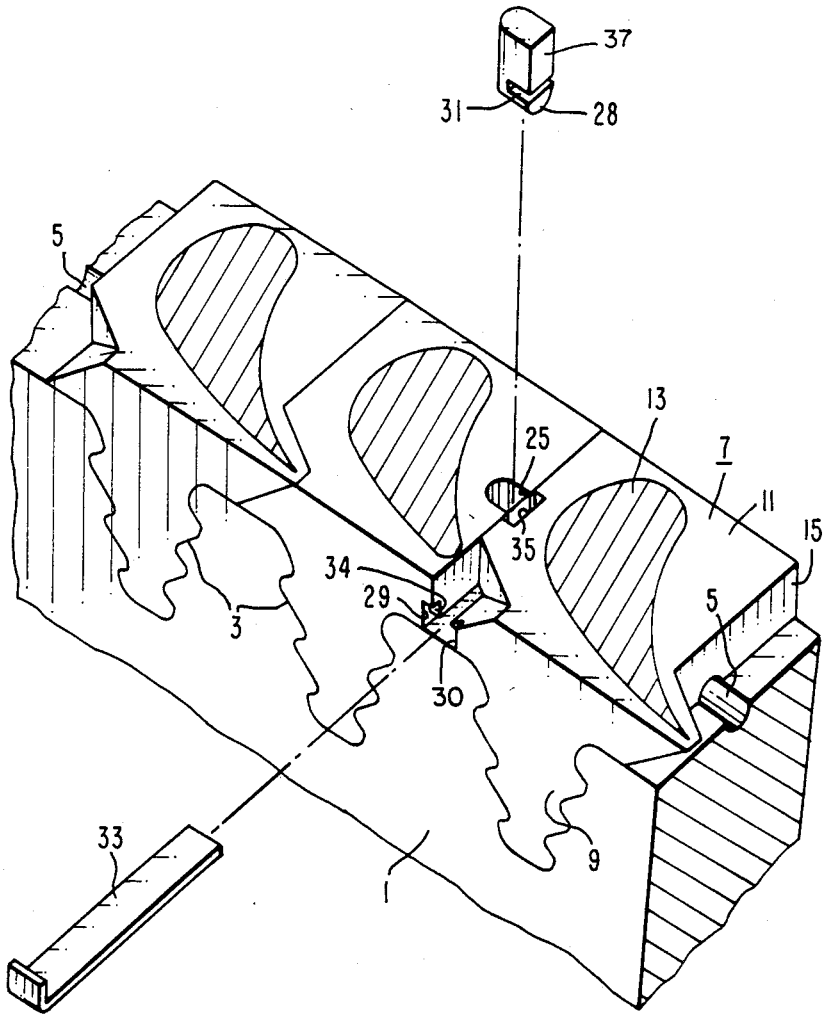
FIG. 3 is a pictorial view of an alternative pinning arrangement.

FIG. 3 shows an alternative embodiment in which the blade abutting the side margin of the closing blade having the kerf 25 also has a kerf 35 which registers with the kerf 25 but is axially wider. The kerfs 25 and 35 receive a locking key 37 which is similar to the locking key 27. The key 37 fits tightly in the kerf 25 and groove 5 and loosely in kerf 36 allowing the kerf 25 to be shallower. The same holding strip 33 is utilized with the locking key 37.

The locking system hereinbefore described advantageously locks the closing side entry blade directly to the rotor; requires no special rotor machining to accomodate the locking system; facilitates easy modification of the first and last blades placed in the array to provide the necessary kerfs and steps in the blade; provides for easy assembly, disassembly, and inspection; provides a redundancy in that either the locking key 27 or 37 or the holding strip 33 can independently hold the closing blade in place; and provide for enclosing the locking parts within the blades and rotor so as to shield them from corrosion and erosion.

What is claimed is:

1. A locking system for a closing blade of a circular array of side entry blades disposed in a rotor disc, said locking system comprising:

a rotor disc;

a circular array of rotating blades including a locking blade;

locking pins for locking all blades to the rotor disc except said closing blade;

said rotor disc having a circumferential groove disposed on an outer periphery and a plurality of generally axially oriented slots adapted to slidably receive said blades in such a manner as to only allow generally axial movement of the blades in the slots;

all said blades having a root portion, which is slidably received by said slots, a platform portion disposed radially outwardly of the root portion;

said platform portion of each blade having generally parallel side margins which a but the side margins of adjacent blades and an airfoil-shaped portion, which extends radially outwardly from the platform portion;

all blades other than the closing blade having a notch in the platform portion on one side of the blade which registers with the circumferential groove;

the notches cooperating with the circumferential groove to form openings for receiving said locking pins, which when placed in the notches and groove prevent the blades other than the closing blade from moving generally axially with respect to the rotor;

said abutting side margins of the adjacent blades capturing said locking pins in said notches and groove;

said closing blade having a kerf in one of the side margins in the same location as the notch;

a locking key fitting into the kerf in the closing blade and the groove in the rotor disc to prevent the closing blade from moving axially in the slot in the rotor disc;

a step disposed in the radially inner portion of the margin of the platform having the kerf and a step disposed in the radial inner portion of the margin of the platform of the blade adjacent thereto; a slit disposed in said locking key which registers with said steps to form an opening extending through the platform having the kerf, the abutting platform and the locking key; and a strip which fits said opening through said platforms and locking key to capture the locking key in the kerf and groove;

the ends of the strip being bent radially to prevent the strip from coming out of the opening through the platforms, wereby all of the blades in the circular array of side entry blades can be locked in the receiving slots in the disc to prevent generally axial movement thereof.

2. A locking system as set forth in claim 1, wherein the closing blade and the blade which abuts the margin of the closing blade having the kerf, each having notches in each end of the platform which register forming openings on opposite ends of the platforms for receiving the bent ends of the strip.

3. A locking system as set forth in claim 1, wherein the platform of the blade abutting the margin of the closing blade having a kerf has a kerf which registers with the kerf in the closing blade and cooperates therewith to receive the locking key.

4. A locking system as set forth in claim 3 wherein the corners of the platform adjacent the step in the closing blade and the corners of the platform adjacent the step in the blade having a margin abutting the margin of the closing blade having the kerf have notches which cooperate to from an opening for receiving the bent ends of the strip.

5. A locking system as set forth in claim 1, wherein one end of the locking key is semicircular and registers with the groove in the disc which is semicircular and the slit in the locking key is adjacent the semicircular end of the locking key.

* * * * *